United States Patent [19]

Welch

[11] Patent Number: 4,492,646

[45] Date of Patent: Jan. 8, 1985

[54] LIQUID DISHWASHING DETERGENT CONTAINING ANIONIC SURFACTANT, SUDS STABILIZER AND HIGHLY ETHOXYLATED NONIONIC DRAINAGE PROMOTOR

[75] Inventor: John B. Welch, Cincinnati, Ohio

[73] Assignee: The Procter & Gamble Company, Cincinnati, Ohio

[21] Appl. No.: 581,222

[22] Filed: Feb. 22, 1984

Related U.S. Application Data

[63] Continuation of Ser. No. 354,679, Mar. 4, 1982, abandoned, which is a continuation of Ser. No. 230,143, Jan. 31, 1981, abandoned, which is a continuation-in-part of Ser. No. 118,705, Feb. 5, 1980, abandoned.

[51] Int. Cl.[3] ..... C11D 1/722; C11D 1/75; C11D 1/83; C11D 3/066

[52] U.S. Cl. ..... 252/528; 252/173; 252/174.14; 252/174.21; 252/529; 252/530; 252/531; 252/535; 252/536; 252/540; 252/547; 252/548; 252/550; 252/551; 252/554; 252/555; 252/559; 252/DIG. 1; 252/DIG. 14

[58] Field of Search ..... 252/173, 174.21, 174.22, 252/528, 529, 531, 532, 535, 536, 540, 547, 548, 550, 551, 554, 555, 559, DIG. 1, DIG. 13, DIG. 14

[56] References Cited

U.S. PATENT DOCUMENTS

| | | |
|---|---|---|
| 2,469,493 | 7/1947 | Barker . |
| 2,874,126 | 2/1959 | Epstein et al. . |
| 2,913,416 | 11/1959 | Fineman et al. . |
| 2,920,045 | 1/1960 | Hearn et al. . |
| 3,634,266 | 1/1972 | Theile . |
| 3,714,074 | 1/1973 | Inamorato . |
| 3,812,042 | 5/1974 | Verdier . |
| 3,869,412 | 3/1975 | Waag . |
| 3,928,249 | 12/1975 | Nunziata et al. . |
| 3,928,251 | 12/1975 | Bolich . |
| 3,983,079 | 9/1976 | Spadini et al. . |
| 3,998,750 | 12/1976 | Payne et al. . |
| 4,029,608 | 6/1977 | Murata et al. . |
| 4,040,989 | 8/1977 | Renaud et al. . |
| 4,077,911 | 3/1978 | Okumura . |
| 4,111,855 | 9/1978 | Barrat . |
| 4,144,201 | 3/1979 | Winterbotham et al. . |

FOREIGN PATENT DOCUMENTS

| | | |
|---|---|---|
| 807599 | 11/1973 | Belgium |
| 845,184 | 2/1977 | Belgium |
| 2715351 | 3/1978 | Fed. Rep. of Germany . |

*Primary Examiner*—Dennis L. Albrecht

*Attorney, Agent, or Firm*—Donald E. Hasse; Edmund F. Gebhardt; Robert B. Aylor

[57] ABSTRACT

Aqueous liquid dishwashing detergent compositions are prepared containing from about 10% to about 50% of an anionic surfactant, from about 2% to about 20% of a relatively highly ethoxylated draining promoting nonionic surfactant, from about 1.5% to about 10% of a suds stabilizing nonionic surfactant, and from about 20% to about 88% water. The compositions exhibit advantages of less filming and spotting for tableware washed in dilute solutions of the compositions after rinsing and drain drying.

8 Claims, No Drawings

LIQUID DISHWASHING DETERGENT CONTAINING ANIONIC SURFACTANT, SUDS STABILIZER AND HIGHLY ETHOXYLATED NONIONIC DRAINAGE PROMOTOR

CROSS REFERENCE TO RELATED APPLICATION

This application is a continuation of application Ser. No. 354,679, filed on Mar. 4, 1982 now abandoned, which is a continuation of my copending application U.S. Ser. No. 230,143, filed Jan. 30, 1981, now abandoned, which is continuation-in-part of my copending application Ser. No. 118,705, filed Feb. 5, 1980, now abandoned, for Liquid Detergent Composition.

TECHNICAL FIELD AND BACKGROUND ART

The invention relates to aqueous high sudsing liquid detergent compositions containing specified amounts and types of surfactants especially useful in the washing of tableware, kitchenware and other hard surfaces.

The compositions of this invention provide more complete drainage of rinse water from surfaces such as glass, ceramics and metal, thereby reducing spotting and filming, particularly in a dishwashing procedure that involves drain drying without towel drying and polishing.

The performance of a detergent composition for cleaning glasses, dishes, and other articles with a normally shiny surface is evaluated by the consumer in terms of shine and the absence of filming, streaking, and spotting. The liquid dishwashing detergent compositions presently on the market are designed to remove the soils from glasses, dishes, and other tableware and kitchen utensils. The detergent solution and redeposited soil residues are normally removed from the washed articles by rinsing and optionally by towel drying the articles when they are still wet. If not rinsed and towel dried, these residues can dry upon the surfaces of the washed articles, leaving films, streaks, or spots.

Even when such articles are entirely clean but rinsed in plain water containing dissolved salts such as water hardness, spots and streaks can appear on the washed and rinsed surfaces upon evaporation of the water.

Towel drying of washed articles, e.g., glasses and dishes, immediately after removal from the washing and rinsing solution, is undesirable from the standpoints of convenience and hygiene. Therefore, it is common practice to put the washed or washed and rinsed articles aside for draining and air-drying. Consequently, the cleaning efficacy of the product used, which the housewife may have visually appreciated at the end of the washing or rinsing cycle, is diminished due to the adherence of redeposited soil, residual dried detergent, and water hardness residues.

U.S. Pat. No. 3,963,649, Spadini et al, discloses liquid detergent compositions containing a nonionic surfactant and a water-soluble gel-forming gelatin. These compositions are said to minimize filming, streaking and spotting of tableware and kitchen utensils. The essential nonionic surfactant may be a tertiary amine or phosphine oxide, an amide or a condensation product of ethylene oxide and an organic hydrophobic compound.

U.S. Pat. No. 3,983,079, Spadini et al, discloses dishwashing detergent compositions said to have good rinse water draining characteristics. The compositions contain a water-soluble quaternary ammonium compound, a nonionic surfactant containing both ethylene oxide and propylene oxide and a sultaine or betaine zwitterionic surfactant.

U.S. Pat. No. 4,144,201, Winterbotham et al, discloses liquid dishwashing detergent compositions containing soluble casein to improve drain-dry and mildness properties.

Belgium Pat. No. 845,184 discloses liquid and granular dishwashing detergent compositions containing one or more specified classes of surfactants to ensure rapid drainage and provide a shiny surface.

It is an object of the present invention to provide liquid detergent compositions and a process for dishwashing that promote rapid and relatively complete drainage of rinse water thereby reducing spotting and filming on surfaces such as glass, ceramics and metal.

There is a continuing need for compositions and methods which can be employed during dishwashing operations to improve the final dry appearance of washed and dried kitchen utensils and articles. If such compositions and methods are intended to be useful for conventional dishwashing soil removal operations, there is a continuing need for a compatible combination of materials which will simultaneously provide the surfactancy, sudsing, and mildness attributes of an acceptable dishwashing detergent composition as well as the anti-spotting and anti-filming benefits described above.

SUMMARY OF THE INVENTION

The present invention comprises a liquid detergent composition containing by weight:

(a) from about 10% to about 50% of an anionic surfactant;

(b) from about 2% to about 20% of a drainage promoting nonionic surfactant selected from the group consisting of:

(i) an ethoxylated aliphatic alcohol of the formula $$R(OC_2H_4)_nOH$$

wherein R is an aliphatic hydrocarbyl radical containing from about 16 to about 30 carbon atoms, wherein n is from about 16 to about 100;

(ii) an ethoxylated alkyl phenol of the formula $$R(OC_2H_4)_nOH$$

wherein R is an alkyl phenyl radical containing a total of from about 18 to about 30 carbon atoms and at least one alkyl group containing at least about 12 carbon atoms wherein n is from about 16 to about 100;

(iii) the condensation product of mono $C_{16-22}$ fatty acid esters of polyglycols with from about 13 to about 100 moles of ethylene oxide per mole of the mono-ester;

(iv) the condensation product of cholesterol and from about 13 to about 100 moles of ethylene oxide;

(v) a material which is a condensate of ethylene oxide, propylene oxide and a compound containing hydroxy or amine groups onto which alkylene oxides can be polymerized, said polymer having a molecular weight of from about 500 to about 15,000, an ethylene oxide content of from about 30% to about 70% by weight and a propylene oxide content of from about 30% to about 70% by weight; and (vi) mixtures thereof;

(c) from about 1.5% to about 10% of a suds stabilizing nonionic surfactant selected from the group consisting of amides, amine oxides and mixtures thereof;

(d) from 0% to about 10% of a detergency builder selected from inorganic phosphates, polyphosphates, silicates, and carbonates, organic carboxylates, phosphonates and mixtures thereof; and (e) from about 20% to about 88% water.

In the process or method aspect of the invention, dishware, glassware, and other tableware and kitchenware are washed in water solutions of the detergent composition, generally at a weight concentration of about 0.05% to about 0.4% of the composition in water at a temperature of about 80° F. to about 120° F. The tableware and kitchenware are then rinsed, drained, and allowed to dry in a rack or other means of separation.

DETAILED DESCRIPTION OF THE INVENTION

The liquid detergent compositions of the present invention contain three essential components:

(a) an anionic surfactant (b) a drainage promoting ethoxylated nonionic surfactant (c) a suds stabilizing nonionic surfactant (d) water.

Optional ingredients can be added to provide various performance and aesthetic characteristics.

ANIONIC SURFACTANT

The compositions of this invention contain from about 10% to about 50% by weight of an anionic surfactant or mixtures thereof. Preferred compositions contain from about 20% to about 35% of anionic surfactant by weight.

Most anionic detergents can be broadly described as the water-soluble salts, particularly the alkali metal, alkaline earth metal, ammonium and amine salts, of organic sulfuric reaction products having in their molecular structure an alkyl radical containing from about 8 to about 22 carbon atoms and a radical selected from the group consisting of sulfonic acid and sulfuric acid ester radicals. Included in the term alkyl is the alkyl portion of acyl radicals. Examples of the anionic synthetic detergents which can form the surfactant component of the compositions of the present invention are the sodium, ammonium, potassium or magnesium alkyl sulfates, especially those obtained by sulfating the higher alcohols ($C_8$-$C_{18}$ carbon atoms) sodium or magnesium alkyl benzene or alkyl toluene sulfonates, in which the alkyl group contains from about 9 to about 15 carbon atoms, the alkyl radical being either a straight or branched aliphatic chain; sodium or magnesium paraffin sulfonates and olefin sulfonates in which the alkyl or alkenyl group contains from about 10 to about 20 carbon atoms; sodium $C_{10-20}$ alkyl glyceryl ether sulfonates, especially those ethers of alcohols derived from tallow and coconut oil; sodium coconut oil fatty acid monoglyceride sulfates and sulfonates; sodium, ammonium or magnesium salts of alkyl phenol ethylene oxide ether sulfates with about 1 to about 30 units of ethylene oxide per molecule and in which the alkyl radicals contain from 8 to about 12 carbon atoms; the reaction products of fatty acids esterified with isethionic acid and neutralized with sodium hydroxide where, for example, the fatty acids are derived from coconut oil; sodium or potassium salts of fatty acid amides of a methyl tauride in which the fatty acids, for example, are derived from coconut oil and sodium or potassium beta-acetoxy or beta-acetamido-alkanesulfonates where the alkane has from 8 to 22 carbon atoms.

Specific examples of alkyl sulfate salts which can be employed in the instant detergent compositions include sodium lauryl alkyl sulfate, sodium stearyl alkyl sulfate, sodium palmityl alkyl sulfate, sodium decyl sulfate, sodium myristyl alkyl sulfate, potassium lauryl alkyl sulfate, potassium stearyl alkyl sulfate, potassium decyl sulfate, potassium palmityl alkyl sulfate, potassium myristyl alkyl sulfate, sodium dodecyl sulfate, magnesium dodecyl sulfate, potassium tallow alkyl sulfate, sodium tallow alkyl sulfate, sodium coconut alkyl sulfate, potassium coconut alkyl sulfate, magnesium $C_{12-15}$ alkyl sulfate and mixtures of these surfactants. Preferred alkyl sulfates include sodium $C_{12-15}$ alkyl sulfates and magnesium $C_{12-15}$ alkyl sulfate.

Suitable alkylbenzene or alkyltoluene sulfonates include the alkali metal (lithium, sodium, potassium), alkaline earth (calcium, magnesium) ammonium and alkanolamine salts of straight or branched-chain alkylbenzene or alkyltoluene sulfonic acids. Alkylbenzene sulfonic acids useful as precursors for these surfactants include decyl benzene sulfonic acid, undecyl benzene sulfonic acid, dodecyl benzene sulfonic acid, tridecyl benzene sulfonic acid, tetrapropylene benzene sulfonic acid and mixtures thereof. Preferred sulfonic acids as precursors of the alkyl-benzene sulfonates useful for compositions herein are those in which the alkyl chain is linear and averages about 11 to 13 carbon atoms in length. Examples of commercially available alkyl benzene sulfonic acids useful in the present invention include Conoco SA 515 and SA 597 marketed by the Continental Oil Company and Calsoft LAS 99 marketed by the Pilot Chemical Company.

Particularly preferred anionic surfactants useful herein are alkyl ether sulfates having the formula $RO(C_2H_4O)_xSO_3M$ wherein R is alkyl or alkenyl of about 10 to about 20 carbon atoms, x is 1 to 30, and M is a water-soluble cation. The alkyl ether sulfates useful in the present invention are condensation products of ethylene oxide and monohydric alcohols having from about 10 to about 20 carbon atoms. Preferably, R has 10 to 16 carbon atoms. The alcohols can be derived from natural fats, e.g., coconut oil or tallow, or can be synthetic. Such alcohols are reacted with 1 to 30, and especially 1 to 12, molar proportions of ethylene oxide and the resulting mixture of molecular species is sulfated and neutralized.

Specific examples of alkyl ether sulfates of the present invention are sodium coconut alkyl triethylene glycol ether sulfate, magnesium $C_{12-15}$ alkyl triethylene glycol ether sulfate, and sodium tallow alkyl hexaoxy ethylene sulfate. Preferred alkyl ether sulfates are those comprising a mixture of individual compounds, said mixture having an average alkyl chain length of from about 12 to 16 carbon atoms and an average degree of ethoxylation of from about 1 to 12 moles of ethylene oxide.

Additional examples of anionic surfactants useful herein are the compounds which contain two anionic functional groups. These are referred to as dianionic surfactants. Suitable dianionic surfactants are the disulfonates, disulfates, or mixtures thereof which may be represented by the following formula:

$$R(SO_3)_2M_2, R(SO_4)_2M_2, R(SO_3)(SO_4)M_2$$

where R is an acyclic aliphatic hydrocarbyl group having 15 to 20 carbon atoms and M is a water-solubilizing cation, for example, the $C_{15}$ to $C_{20}$ disodium 1,2-alkyldisulfates, $C_{15}$ to $C_{20}$ dipotassium-1,2-alkyldisulfonates or disulfates, di-sodium 1,9-hexadecyl disulfates, $C_{15}$ to $C_{20}$ disodium 1,2-alkyldisulfonates, disodium 1,9-stearyldisulfates and 6,10-octadecyldisulfates.

DRAINAGE PROMOTING ETHOXYLATED NONIONIC SURFACTANT

The ethoxylated nonionic surfactants of the present invention are the condensation product of alcohols, alkyl phenols and other specified hydrophobic molecules with ethylene oxide. The materials hereinafter disclosed have not been used in aqueous liquid detergent compositions having the required formulation characteristics of the present invention. Their ability to improve rinse water drainage characteristics had not been recognized. Suds stabilizing nonionic surfactants hereinafter described have been in general use, but by themselves do not provide the improved drainage characteristics. Preferably, the compositions of the present invention contain from about 2% to about 20%, more preferably from about 3% to about 12%, and most preferably from about 3% to about 8%, of drainage promoting ethoxylated aliphatic alcohols of the formula $$R(OC_2H_4)_nOH$$

wherein R is an aliphatic hydrocarbyl radical containing from about 16 to about 30 carbon atoms, wherein n is from about 16 to about 100.

Other ethoxylated nonionic surfactants at a level of from about 2% to about 20% can provide the drainage promoting characteristics of ethoxylated alcohols, but are less desirable for reasons of biodegradability and effect on sudsing or cleaning performance. Examples of such alternate ethoxylated nonionic surfactants are:

(1) an ethoxylated alkyl phenol of the formula $R(OC_2H_4)_nOH$ wherein R is an alkyl phenyl radical containing a total of from about 18 to about 30 carbon atoms and at least one alkyl group containing at least about 12 carbon atoms wherein n is from about 16 to about 100;

(2) the condensation product of mono $C_{16-22}$ fatty acid esters of polyglycols with from about 13 to about 100 moles of ethylene oxide per mole of partial ester;

(3) the condensation product of cholesterol and from about 13 to about 100 moles of ethylene oxide;

(4) a material which is a condensate of ethylene oxide, propylene oxide and a compound containing hydroxy or amine groups onto which the alkylene oxides can be polymerized, said polymer having a molecular weight of from about 500 to about 15,000, an ethylene oxide content of from about 30% to about 70% by weight and a propylene oxide content of from about 30% to about 70% by weight.

In a particularly preferred embodiment an aliphatic alcohol contains from about 16 to about 22 carbon atoms and is ethoxylated to an average degree of from about 18 to about 50 moles of ethylene oxide per mole of alcohol.

SUDS STABILIZING NONIONIC SURFACTANT

The compositions of this invention contain from about 1.5% to about 10%, preferably from about 2% to about 8%, of suds stabilizing nonionic surfactant or mixtures thereof having a different chemical structure and function than the essential drainage promoting nonionic surfactant.

Suds stabilizing nonionic surfactants operable in the instant compositions are two basic types—amides and the amine oxide semi-polar nonionics.

The amide type of nonionic surface active agent include the ammonia, monoethanol and diethanol amides of fatty acids having an acyl moiety of from about 8 to about 18 carbon atoms and represented by the general formula $$R_1—CO—N(H)_{m-1}(R_2OH)_{3-m}$$

wherein $R_1$ is a saturated or unsaturated, aliphatic hydrocarbon radical having from 7 to 21, preferably from 11 to 17 carbon atoms; $R_2$ represents a methylene or ethylene group; and m is 1, 2, or 3, preferably 1 or 2. Specific examples of said amides are mono-ethanol coconut fatty acid amide and diethanol dodecyl fatty acid amide. These acyl moieties may be derived from naturally occurring glycerides, e.g., coconut oil, palm oil, soybean oil and tallow, but can be derived synthetically, e.g., by the oxidation of petroleum, or hydrogenation of carbon monoxide by the Fischer-Tropsch process. The monoethanol amides and diethanolamides of $C_{12-14}$ fatty acids are preferred.

Amine oxide semi-polar nonionic surface active agents comprise compounds and mixtures of compounds having the formula:

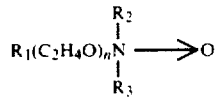

wherein $R_1$ is an alkyl, 2-hydroxyalkyl, 3-hydroxyalkyl, or 3-alkoxy-2-hydroxypropyl radical in which the alkyl and alkoxy, respectively, contain from about 8 to about 18 carbon atoms, $R_2$ and $R_3$ are methyl, ethyl, propyl, isopropyl, 2-hydroxyethyl, 2-hydroxypropyl, or 3-hydroxypropyl and n is from 0 to about 10. Preferably preferred are amine oxides of the formula:

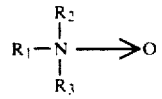

wherein $R_1$ is a $C_{10-14}$ alkyl and $R_2$ and $R_3$ are methyl or ethyl.

The preferred sudsing characteristics of the compositions of the invention are those which will provide the user of the product with an indication of cleaning potential in a dishwashing solution. Soils encountered in dishwashing act as suds depressants and the presence or absence of suds from the surface of a dishwashing solution is a convenient guide to product usage. Mixtures of anionic surfactants and suds stabilizing nonionic surfactants are utilized in the compositions of the invention because of their high sudsing characteristics, their suds stability in the presence of food soils and their ability to indicate accurately an adequate level of product usage in the presence of soil. Additionally, and most importantly, compositions containing the other two essential surfactants of the invention but not the suds stabilizing nonionic surfactants as defined herein, do not provide an optimum draining promoting effect.

In preferred embodiments of the invention, the ratio of anionic surfactants to total nonionic surfactants in the composition will be in a molar ratio of from about 11:1 to about 1:1, and more preferably from about 8:1 to about 3:1. From the standpoint of sudsing, the suds stabilizing nonionic surfactants are generally preferred, but the essential relatively highly ethoxylated drainage promoting nonionic surfactants of the invention can contribute to sudsing performance and are included in the calculation of ratios of anionic to nonionic surfactant.

OTHER OPTIONAL SURFACTANTS

The compositions of the invention may contain optional surfactants such as ampholytic, zwitterionic and cationic surfactants.

Ampholytic surfactants can be broadly described as derivatives of aliphatic amines which contain a long chain of about 8 to 18 carbon atoms and an anionic water-solubilizing group, e.g. carboxy, sulfo or sulfate. Examples of compounds falling within this definition are sodium-3-dodecylamino propane sulfonate, and dodecyl dimethylammonium hexanoate.

Zwitterionic surface active agents operable in the instant composition are broadly described as internally-neutralized derivatives of aliphatic quaternary ammonium and phosphonium and tertiary sulfonium compounds in which the aliphatic radical can be straight chain or branched, and wherein one of the aliphatic substituents contains from about 8 to 18 carbon atoms and one contains an anionic water solubilizing group, e.g., carboxy, sulfo, sulfato, phosphato, or phosphono.

Cationic surfactants such as quaternary ammonium compounds can find optional use in the practice of the invention to the extent they are compatible with the other surfactants in the particular composition.

WATER

The compositions of this invention contain from about 20% to about 88%, preferably from about 40% to about 70%, water.

ADDITIONAL OPTIONAL INGREDIENTS

The compositions of this invention can contain up to about 10%, by weight of detergency builders either of the organic or inorganic type. Examples of water-soluble inorganic builders which can be used, alone or in admixture with themselves and organic alkaline sequestrant builder salts, are alkali metal carbonates, phosphates, polyphosphates, and silicates. Specific examples of such salts are sodium tripolyphosphate, sodium carbonate, potassium carbonate, sodium pyrophosphate, potassium pyrophosphate, potassium tripolyphosphate, and sodium hexametaphosphate. Examples of organic builder salts which can be used alone, or in admixture with each other or with the preceding inorganic alkaline builder salts, are alkali metal polycarboxylates, e.g., water-soluble citrates such as sodium and potassium citrate, sodium and potassium tartrate, sodium and potassium ethylenediaminetetraacetate, sodium and potassium N-(2-hydroxyethyl)-ethylene diamine triacetates, sodium and potassium nitrilo triacetates (NTA) and sodium and potassium N-(2-hydroxyethyl)-nitrilo diacetates. Other organic detergency builders such as water-soluble phosphonates can find use in the compositions of the invention. In general, however, detergency builders have limited value in dishwashing detergent compositions and use at levels above about 10% can restrict formulation flexibility in liquid compositions because of solubility and phase stability considerations.

Alcohols, such as ethyl alcohol, and hydrotropes, such as sodium and potassium toluene sulfonate, sodium and potassium xylene sulfonate, trisodium sulfosuccinate and related compounds (as disclosed in U.S. Pat. No. 3,915,903, incorporated herein by reference) and urea, can be utilized in the interests of achieving a desired product phase stability and viscosity. Ethyl alcohol at a level of from about 3% to about 15% and potassium or sodium toluene, xylene or cumine sulfonate at a level of from about 1% to about 6% are particularly useful in the compositions of the invention.

The detergent compositions of this invention can contain, if desired, any of the usual adjuvants, diluents and additives, for example, perfumes, enzymes, dyes, antitarnishing agents, antimicrobial agents, and the like, without detracting from the advantageous properties of the compositions. Alkalinity sources and pH buffering agents such as monoethanolamine, triethanolamine and alkali metal hydroxides can also be utilized.

The following examples are given to illustrate the compositions of the invention. All percentages are by weight unless otherwise indicated.

EXAMPLE I

The following liquid detergent compositions were prepared.

| | A | B | C |
|---|---|---|---|
| Ammonium $C_{12}$ alkyl sulfate | 4.3% | 4.3% | 12.5% |
| Ammonium $C_{12}$ alkyl sulfate-ethoxy (1) | 19.9 | 19.9 | — |
| Ammonium $C_{12}$ alkyl sulfate-ethoxy (3) | — | — | 13.5 |
| Dimethyldodecylamine oxide | 2.3 | 1.7 | 4.0 |
| Tallow alcohol-ethoxy (22) | 5.0 | 4.0 | — |
| Ethanol | 6.2 | 6.2 | 6.2 |
| Ammonium xylene sulfonate | 2.5 | 2.5 | 2.5 |
| Magnesium chloride | 3.1 | 3.1 | — |
| Potassium chloride | — | — | 0.7 |
| Water | 56.2 | 57.8 | 60.1 |
| Perfume and miscellaneous | 0.5 | 0.5 | 0.5 |

Compositions A and B are within the scope of the present invention. Composition C is typical of presently used dishwashing liquid detergent compositions and is outside the scope of the present invention.

SPOTTING AND FILMING PERFORMANCE

"Libby" glasses were soiled with a fatty soil containing milk solids and washed in 115° F. water solutions containing 0.2% of Compositions A, B and C. The glasses were rinsed in 115° F. water, rack dried, graded on a 1-10 scale (1 poorest, 10 best) for spotting and filming. The glasses were also comparison graded for overall appearance using a scale of 0 to 4 to indicate no difference to a large advantage for one of the glasses in the comparison.

Average Conditions—0.25% soil and 7 grains/gallon water hardness measured as $CaCO_3$

| | A | B | C | Least Significant Difference - .05 |
|---|---|---|---|---|
| Spotting | 7.4 | 7.3 | 6.7 | 0.32 |
| Filming | 7.7 | 7.5 | 7.4 | 0.22 |
| Appearance | +0.5 | +0.2 | -1.4 | 0.7 |

Stress Conditions—0.35% soil and 10 grains/gallon water hardness measured as $CaCO_3$

| | A | B | C | Least Significant Difference - 0.05 |
|---|---|---|---|---|
| Spotting | 7.3 | 7.3 | 6.4 | 0.27 |
| Filming | 7.4 | 7.5 | 7.2 | 0.25 |
| Appearance | +0.1 | −0.1 | −1.8 | 1.1 |

SUDSING

Suds were generated by agitation in dishpans containing 2 gallons of 115° F. water using Compositions A, B and C at a 0.2% product concentration. Dinner plates were washed with the introducing of 4.0 ml of a triglyceride-containing soil on each plate. Suds height is measured after washing sets of five plates. This procedure is repeated five times for a total of 25 plates. The suds height after washing each set is expressed in terms of percent of original suds height and an average of the five values is reported as suds during washing (SDW). The number of plates washed when suds disappear from the surface of the dishwashing solution is recorded as "mileage".

The following sudsing results were obtained:

| Soil | Water Hardness | SDW/Mileage A | B | C | LSD - .05 |
|---|---|---|---|---|---|
| 100% fat | 2 | 16.3/— | 17.4/— | 14.9/— | 2.5/— |
| | 7 | 17.2/— | 17.2/— | 17.3/— | 1.6/— |
| | 14 | 13.0/— | 12.4/— | 11.4/— | 6.0/— |
| Mixed fat, | 2 | 14.8/32 | 14.5/31 | 13.6/30 | 4.8/5.3 |
| protein | 7 | 12.5/21 | 12.2/21 | 13.0/21 | 2.7/4.9 |
| carbohydrate and acid | 7 | 12.4/31 | 12.6/29 | 10.5/28 | 5.0/9.1 |

Compositions A and B had sudsing characteristics equivalent to C and provided a superior appearance and freedom from spotting and filming after washing and rinsing.

The following materials are substituted for the tallow alcohol-ethoxy (22) in Compositions A and B:

(1) $C_{13-15}$ alkyl phenol-ethoxy (30)
(2) cholesterol-ethoxy (24)
(3) sorbitan monoleate-ethoxy (80)
(4) glyceryl monostearate-ethoxy (20)
(5) $C_{12}$ alkanol-ethoxy (20)
(6) $C_{18}$ alkanol-ethoxy (20)

Comparable sudsing, appearance, filming and spotting performance relative to Composition C is obtained.

EXAMPLE II

The following liquid dishwashing detergent compositions were prepared:

| | D | E | F |
|---|---|---|---|
| Ammonium $C_{12}$ alkyl sulfate | 12.5% | 4.3% | — |
| Ammonium $C_{12}$ alkyl sulfate-ethoxy (1) | — | 19.9 | — |
| Ammonium $C_{12}$ alkyl sulfate-ethoxy (3) | 13.5 | — | 12.5 |
| Ammonium $C_{11-13}$ alkylbenzene sulfonate | — | — | 18.8 |
| Magnesium chloride | — | 3.1 | — |
| Dimethyldodecylamine oxide | 4.0 | 1.7 | — |
| $C_{12}$ alkyl monoethanolamide | — | — | 1.9 |
| Ammonium xylene sulfonate | 2.5 | — | 2.4 |
| Ethanol | 6.2 | 2.5 | 3.0 |
| Water | 60.3 | 68.5 | 61.4 |

-continued

| | D | E | F |
|---|---|---|---|
| Perfume and miscellaneous | 1.0 | — | — |

For purposes of evaluating spotting and filming performance a variation of Composition D was prepared in which 5% tallow alcohol-ethoxy (22) replaced 5% water. Similarly variations of Composition E were prepared in which 1%, 5% and 20% tallow alcohol-ethoxy (22) replaced water.

Paired comparison grading of the two base compositions and four variations containing tallow alcohol-ethoxy (22) for filming and spotting performance on glassware after washing and rinsing showed:

(1) no difference between base formulas
(2) only a marginal benefit at a 1% tallow alcohol-ethoxy (22) level
(3) a substantial and easily noticeable benefit for the 5% tallow alcohol-ethoxy (22) level
(4) only a marginal benefit in an increase in tallow alcohol-ethoxy (22) from 5% to 20%.

Sudsing of Composition D with 5% tallow alcohol-ethoxy (22) was equivalent to sudsing of Composition C. Composition D with 20% tallow alcohol-ethoxy (22) provided an average suds level approximately 50% of that provided by Composition C.

$C_{12-15}$ alkylbenzene sulfonate, $C_{13-16}$ paraffin sulfonate and $C_{12-16}$ olefin sulfonate are substituted for the $C_{12}$ alkyl sulfate in Compositions C and D. Comparable results are obtained.

$C_{12}$ monoethanolamide at a 6% level replaces 4% dimethyldodecylamine oxide and 2% water in Composition C. Comparable results are obtained.

EXAMPLE III

Variations of Composition D of Example II were prepared with the following materials replacing water.

(1) 5% tallow alcohol-ethoxy (22)
(2) 5% tallow alcohol-ethoxy (11)
(3) 5% $C_{14-15}$ alkanol-ethoxy (7)
(4) 5% $C_{12}$ alkanol-ethoxy (12)
(5) 5% $C_{16}$ alkanol-ethoxy (20)
(6) 5% $C_{12}$ alkanol-ethoxy (20)

Grading of glassware for filming and spotting after washing and rinsing in the compositions showed:

Compositions #3 and #4 provide no improvement over the base Composition D containing no ethoxylated nonionic surfactant. Compositions #1, #5 and #6 provided an easily noticeably benefit relative to the base Composition D and Compositions #2, #3 and #4. Composition #2 had a slightly lower level of filming and spotting relative to the base Composition D, but was substantially less effective than Compositions #1, #5 and #6.

Sudsing of Composition #2 was substantially reduced relative to base Composition D and Composition #1 which was essentially the same as base Composition D.

EXAMPLE IV

Variations of Compositions E of Example II were prepared with the following materials replacing water:

(7) 5% $C_{14-15}$ alkanol-ethoxy (20)
(8) 5% $C_{16}$ alkanol-ethoxy (20)

A variation of Composition F of Example II was prepared with the following material replacing water:

(9) 5% $C_9$ alkyl phenol-ethoxy (40)

Glasses washed and rinsed in the compositions were evaluated for filming and spotting by comparison to each other and base Composition D of Example III and Composition #1 of Example III. #7, #8 and #9 were all superior to base Composition D. Compositions #8 and #9 were essentially equivalent to Composition #1 of Example III; Composition #7 was slightly poorer than Composition #1 of Example III.

EXAMPLE V

A variation of Composition D of Example II was prepared with 17% of Pluridot HA-430 replacing water. Pluridot HA-430 is manufactured by BASF-Wyandotte and is a condensate of ethylene oxide and propylene oxide polymerized on a triol base and having a molecular weight of 3700–4200. The resultant composition provided an advantage of reduced filming and spotting of glassware relative to Composition D.

EXAMPLE VI

The following liquid dishwashing detergent compositions were prepared:

| | G | H | I | J |
|---|---|---|---|---|
| Ammonium $C_{12}$ alkyl sulfate | 4.3% | 4.3% | — | 12.5% |
| Ammonium $C_{12}$ alkyl ether sulfate-ethoxy (1) | 19.9 | 19.9 | — | — |
| Ammonium $C_{12}$ alkyl ether sulfate-ethoxy (3) | — | — | 12.5 | 13.5 |
| Ammonium $C_{12-13}$ alkylbenzene sulfonate | — | — | 18.8 | — |
| Dimethyldodecylamine oxide | 2.8 | 2.8 | — | 4.0 |
| $C_{12}$ alcohol-ethoxy (23) | — | 3.6 | — | — |
| Tallow alcohol-ethoxy (18) | 3.3 | — | — | — |
| Tallow alcohol-ethoxy (22) | — | — | 5.0 | — |
| Ethanol | 6.2 | 6.2 | 3.0 | 6.2 |
| Ammonium xylene sulfonate | 2.5 | 2.5 | 2.4 | 2.5 |
| Magnesium chloride | 3.1 | 3.1 | — | — |
| Potassium chloride | — | — | — | 0.7 |
| Perfume and miscellaneous | 0.5 | 0.5 | 0.5 | 0.5 |
| Water | | remainder | | |

SPOTTING AND FILMING PERFORMANCE

Water glasses were soiled with a fatty soil containing milk solid and washed in 115° F. water solutions containing 0.2% of Compositions G, H, I and J. The glasses were rinsed in 115° F. water and rack dried. Glasses from each treatment were compared for overall spotting and filming appearance. Graders assigned values of +4 to −4 to indicate their satisfaction or dissatisfaction with the end result appearance of the glasses.

Conditions—0.3% soil and 10 grains/gallon water hardness measured as $CaCO_3$.

| | G | H | I | J | Least Significant Difference - 0.05 |
|---|---|---|---|---|---|
| Average Appearance Grade | +0.6 | −0.2 | −0.2 | −0.9 | 0.8 |

Composition G provided a significant appearance advantage relative to the other three compositions. Compositions H and I provided a numerical advantage over Composition J not statistically significant at a 95% confidence level. Only Composition G provided results on the positive side of the satisfaction scale.

What is claimed is:

1. A liquid detergent composition comprising, by weight:

(a) from about 10% to about 50% of an anionic surfactant;

(b) from about 3% to about 8% of a drainage promoting nonionic surfactant selected from the group consisting of:

(i) an ethoxylated aliphatic alcohol of the formula $$R(OC_2H_4)_nOH$$

wherein R is an aliphatic hydrocarbyl radical containing from about 16 to about 30 carbon atoms, and n is from about 16 to about 100;

(ii) an ethoxylated alkyl phenol of the formula $$R(OC_2H_4)_nOH$$

wherein R is an alkyl phenyl radical containing a total of from about 18 to about 30 carbon atoms and at least one alkyl group containing at least about 12 carbon atoms, and n is from about 16 to about 100;

(iii) the condensation product of mono $C_{16-22}$ fatty acid esters of polyglycols with from about 13 to about 100 moles of ethylene oxide per mole of the monoester;

(iv) the condensation product of cholesterol and from about 13 to about 100 moles of ethylene oxide;

(v) a material which is a condensate of ethylene oxide, propylene oxide and a compound containing hydroxy or amine groups onto which alkylene oxides can be polymerized, said polymer having a molecular weight of from about 500 to about 15,000, an ethylene oxide content of from about 30% to about 70% by weight and a propylene oxide content of from about 30% to about 70% by weight; and (vi) mixtures thereof;

(c) from about 2% to about 8% of a suds stabilizing nonionic surfactant selected from the group consisting of amine oxides, ammonia, monoethanol and diethanol amides of fatty acids having an acyl moiety of from about 8 to about 18 carbon atoms, and mixtures thereof;

(d) from 0% to about 10% of a detergency builder selected from inorganic phosphates, polyphosphates, silicates and carbonates, organic carboxylates, phosphonates and mixtures thereof; and (e) from about 20% to about 88% water.

2. The composition of claim 1 wherein the drainage promoting nonionic surfactant is an ethoxylated aliphatic alcohol.

3. The composition of claim 2 wherein the molar ratio of anionic surfactant to total nonionic surfactant is from about 11:1 to about 1:1.

4. The composition of claim 3 comprising a suds stabilizing nonionic surfactant selected from the group consisting of dimethyl $C_{12-14}$ alkylamine oxides, $C_{12-14}$ alkyl ethanolamides and mixtures thereof.

5. The composition of claim 4 wherein the anionic surfactant comprises a material selected from the group consisting of alkyl sulfates, alkyl ethoxy ether sulfates, alkyl benzene sulfonates, paraffin sulfonates, olefin sulfonates and mixtures thereof and said anionic surfactant is from about 20% to about 35% by weight of said composition.

6. The composition of claim 5 wherein the drainage promoting nonionic surfactant comprises an ethoxylated aliphatic alcohol of the formula $R(OC_2H_4)_nOH$ wherein R is an aliphatic hydrocarbyl radical containing from about 16 to about 22 carbon atoms and wherein n is from about 18 to about 50.

7. The composition of claim 6 wherein the suds stabilizing nonionic surfactant is a dimethyl $C_{12-14}$ alkylamine oxide.

8. The composition of claim 7 wherein the drainage promoting nonionic surfactant is an ethoxylated tallow alcohol containing about 22 moles of ethylene oxide per mole of alcohol.

* * * * *